US008220077B1

(12) United States Patent
Ott et al.

(10) Patent No.: US 8,220,077 B1
(45) Date of Patent: Jul. 17, 2012

(54) SAFETY STOCKING

(75) Inventors: Bill Ott, Knoxville, TN (US); Shane C Bruce, Lenoir City, TN (US)

(73) Assignee: Albahealth, LLC, Rockwood, TN (US)

( * ) Notice: Subject to any disclaimer, the term of this patent is extended or adjusted under 35 U.S.C. 154(b) by 67 days.

(21) Appl. No.: 12/841,304

(22) Filed: Jul. 22, 2010

(51) Int. Cl.
*A41B 11/10* (2006.01)
*A41B 11/00* (2006.01)

(52) U.S. Cl. ..... 2/239; 2/409

(58) Field of Classification Search ..... 2/239, 240, 2/409, 80, 83
See application file for complete search history.

(56) References Cited

U.S. PATENT DOCUMENTS

| | | | | |
|---|---|---|---|---|
| 832,550 | A * | 10/1906 | Lepper | 2/61 |
| 1,805,035 | A * | 5/1931 | Branley | 66/178 R |
| 4,021,860 | A | 5/1977 | Swallow et al. | |
| 4,069,515 | A | 1/1978 | Swallow et al. | |
| 5,412,957 | A | 5/1995 | Bradberry et al. | |
| 5,590,420 | A * | 1/1997 | Gunn | 2/69 |
| 5,617,585 | A * | 4/1997 | Fons et al. | 2/239 |
| 6,275,997 | B1 * | 8/2001 | Richardson | 2/239 |
| 6,314,584 | B1 * | 11/2001 | Errera | 2/239 |
| 6,378,139 | B1 | 4/2002 | Mazzaglia | |
| 6,385,779 | B2 * | 5/2002 | Boersema | 2/239 |
| 7,346,935 | B1 * | 3/2008 | Patterson | 2/239 |

OTHER PUBLICATIONS web site showing photo of Nova Plus socks, 2009.
web site showing photo of Care-Steps socks, 2009.

* cited by examiner

*Primary Examiner* — Gloria Hale
(74) *Attorney, Agent, or Firm* — Baker, Donelson; Dorian B. Kennedy

(57) ABSTRACT

A safety stocking (10) in the form of a sock (11) includes an elastic, stretchable fabric portion (12) and a patterned anti-skid tread (13). The foot section (14) has a top surface (19) and a bottom surface (20). Both the top surface and the bottom surface are joined to the anti-skid tread. The anti-skid tread pattern extends continuously and symmetrically from a first point (23) adjacent the toes of a wearer to a second point (24) adjacent the heal of a wearer.

9 Claims, 2 Drawing Sheets

SAFETY STOCKING

TECHNICAL FIELD

This invention relates generally to stockings and more specifically to non-slip safety sock.

BACKGROUND OF THE INVENTION

Heretofore, stockings have been designed in the form of a sock which includes a pattern of flexible material applied to the sole. The purpose of the flexible material is to restrict slippage as the wearer stands or walks upon a floor and provide a continuous barrier on the bottom of the sock from fluids or moisture beads when in contact with the floor surface. These types of stockings may be used by medical patients, yoga participants, or people relaxing at home.

While the patterned, flexible material provides increased traction, such may still result in foot slippage upon the underlying floor should the stocking become twisted or mis-positioned upon the wearer's foot.

Accordingly, it is seen that a need remains for a safety stocking that provides a better slip resistance. It is to the provision of such therefore that the present invention is primarily directed.

SUMMARY OF THE INVENTION

In a preferred form of the invention a safety stocking comprises a stretchable fabric material forming a foot section and a leg section. The foot section has an exterior top surface extending from an exterior bottom surface and a non-skid tread coupled to both the bottom surface and the top surface of said foot section along the length of the foot section.

DETAILED DESCRIPTION

Figure 1:
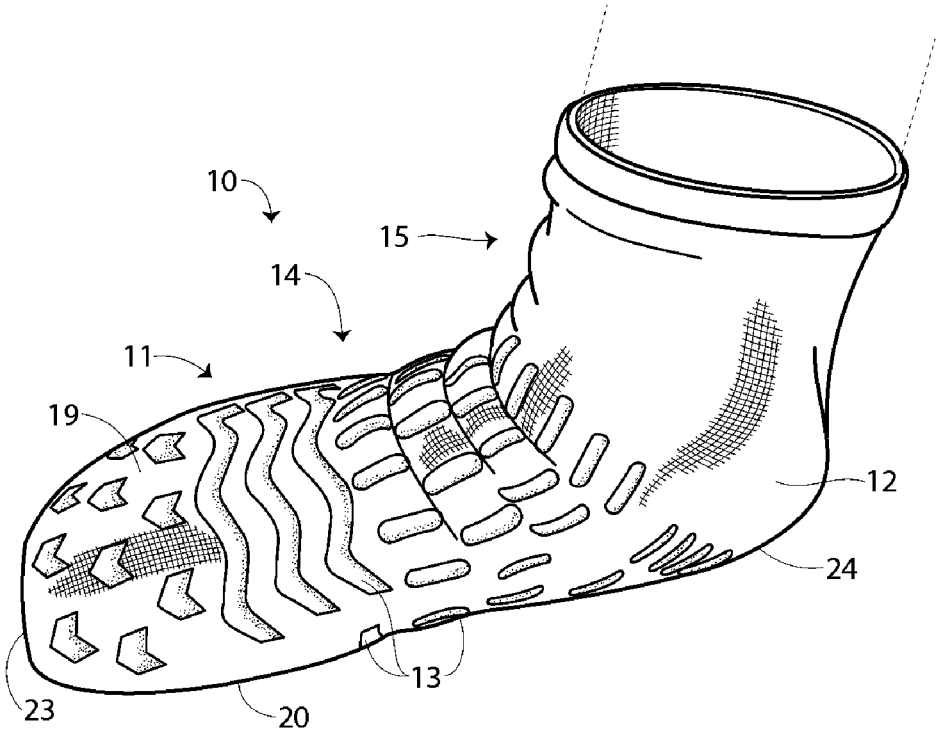
FIG. 1 is a perspective view of a preferred form of the safety stocking shown worn on a person's foot.

With reference next to the drawings, there is shown a safety stocking 10 in a preferred form of the invention. The stocking 10 is in the form of a sock 11 having an elastic, stretchable fabric material portion 12 and a patterned anti-skid tread 13. The fabric portion 12 has a foot section 14 joined to a leg section 15. The leg section 15 may be of various lengths such as to end at different heights along the wearer's leg at a cuff 16, including a very small portion so that the sock is formed as a "footie". The stocking may, of course, be produced in any number of overall sizes to fit people of different foot sizes.

The foot section 14 has an exterior top surface 19 and an exterior bottom surface 20 extending from the top surface, or visa-versa. The anti-skid tread 13 extends on both the top surface 19 and the bottom surface 20 from a first point 23 below and adjacent the toes of a wearer to a second point 24 below and adjacent the heal of a wearer. It is important to note that the tread continues about or circumferentially along the length of the foot section. Preferably, the tread 13 is formed in a pattern of segments which may be all the same size, or different sizes, or of different sizes in selection portions of the foot section. The anti-skid tread 13 generally may also be symmetrical along a longitudinal axis LA so that the stocking may be worn on either foot, i.e., the stocking is not formed to fit a particular foot but may be worn on either the right or left foot. The toe end of the foot section 14 may be formed with a seam along the front edge of the toe area.

The anti-skid tread 13 may be made of a nitrile composite, a PVC material, a PBE material, or any other conventionally know rubber material having a sufficiently high coefficient of friction to restrict slipping on the underlying floor. The goal of reducing slippage is extremely desirous to healthcare, home care, and hospital facilities and the like as such may result in great bodily harm to the weak or elderly, or where normal gait has been affected and may result in greater liability to the medical facility.

In use, the fabric portion 12 is made in any conventional manner. Once the fabric portion 12 is complete it is positioned on a form and the anti-skid tread 13 is then joined or applied to the foot section top and bottom surfaces. The anti-skid tread 13 may be applied by screen printing the tread 13 upon the bottom surface 20 of the foot section.

Figure 3:
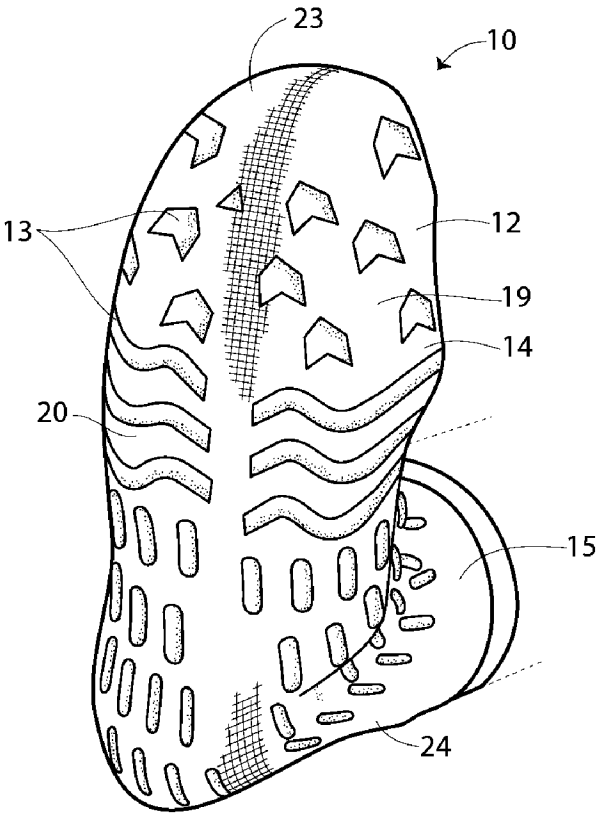
FIG. 3 is a perspective, bottom view of the safety stocking shown worn on a person's foot.
Figure 2:
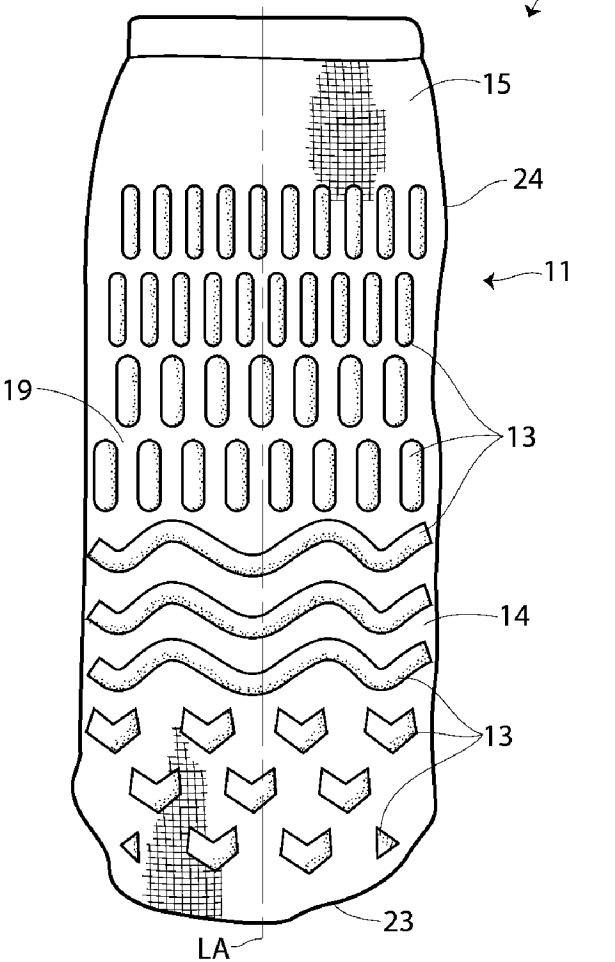
FIG. 2 is a top plan view of the safety stocking shown in FIG. 1, the bottom plan view being the same.

The anti-skid tread 13 preferably covers the majority of the length and width of the foot section top and bottom surfaces. The pattern on both the top and bottom allow the slip resistant anti-skid tread 13 to always be in contact with the underlying floor even if the sock becomes twisted, rotated, or otherwise mis-positioned upon the wearer's foot, as shown in FIG. 3, wherein the bottom tread and top tread have been rotated about the wearer's foot so that a portion of each appears on the opposite side of the wearer's foot. However, even with the stocking rotated in this manner, the slip resistant tread is still positioned across virtually the entire area of the bottom of a wearer's foot to resist slipping on the underlying floor.

As an alternative to using a foot form with the screen printing process, the fabric portion may be laid flat and the tread 13 is then applied by "direct" printing to the bottom surface 20. Also, as an alternative to the direct printing method of applying the tread, the tread 13 may be applied by a heat transfer, or also known as hot-split method. Here, the tread 13 is initially formed as a partially gelled form in the shape of the tread and place on transfer paper. The partially gelled form is placed upon the bottom surface 20 wherein heat and pressure is applied to it causing it to permanently bond to the bottom surface.

It thus is seen that a safety stocking is now provided that provides greater non-skid capabilities even if the stocking is mis-positioned upon a wearer's foot. Although the stocking has been illustrated and described in its preferred form, it should be understood that many modifications, additions and deletions may be made to that specific form without departure from the spirit and scope of the invention as set forth in the following claims.

The invention claimed is:

1. A safety stocking comprising:

a stretchable fabric material forming a foot section and a leg section, said foot section having a length extending from and including a toe portion to a heal portion with an exterior top surface extending from an exterior bottom surface; and a non-skid tread coupled to both said bottom surface and said top surface of said foot section along said length of said foot section.

2. The safety stocking of claim 1 wherein said non-skid tread is made of a field of segments which extend in a pattern on said bottom surface and said top surface of said foot section.

3. The safety stocking of claim 2 wherein said non-skid tread is symmetrical along a longitudinal axis on both said top surface and said bottom surface.

4. A safety stocking comprising:

a sock having an exterior top surface and an exterior bottom surface along a length extending from a top portion to a heal portion; and a rubber tread coupled to both a majority of said length of said top surface and said bottom surface of said sock.

5. The safety stocking of claim 4 wherein said rubber tread is made of a field of segments which extend in a pattern on said bottom surface and said top surface of said foot section.

6. The safety stocking of claim 4 wherein said rubber tread is symmetrical along a longitudinal axis on both said top surface and said bottom surface.

7. A safety stocking comprising:

a stretchable fabric material forming a tubular foot section including a toe portion and a heal portion, and a tubular leg section; and a non-skid tread coupled to said tubular foot section so as to extend circumferentially and longitudinally along both the toe portion and the heal portion of the exterior of said tubular foot section.

8. The safety stocking of claim 7 wherein said non-skid tread is made of a field of tread segments.

9. The safety stocking of claim 7 wherein said non-skid tread is symmetrical along a longitudinal axis of said foot section.

* * * * *